US005439229A

United States Patent [19]

Kaiser

[11] Patent Number: 5,439,229

[45] Date of Patent: Aug. 8, 1995

[54] PARLOR GAME APPARATUS STRIPS

[76] Inventor: Ronald A. Kaiser, 12821 McCracken Rd., Garfield Heights, Ohio 44125

[21] Appl. No.: 232,991

[22] Filed: Apr. 25, 1994

[51] Int. Cl.[6] ..... A63F 3/00

[52] U.S. Cl. ..... 273/256; 273/283

[58] Field of Search ..... 273/236, 242, 243, 256, 273/278, 283, 284, 286, 287

[56] References Cited

U.S. PATENT DOCUMENTS

| | | | |
|---|---|---|---|
| 1,553,611 | 9/1925 | Harrison | 273/283 X |
| 2,026,082 | 12/1935 | Darrow | 273/256 |
| 3,334,903 | 8/1967 | Glass et al. | 273/256 |
| 3,406,975 | 10/1968 | Berger | 273/283 |
| 3,481,606 | 12/1969 | Breslow et al. | 273/283 X |
| 4,526,376 | 7/1985 | Rosenwinkel et al. | 273/283 X |
| 4,585,233 | 4/1986 | Wilson | 273/283 X |
| 5,282,631 | 2/1994 | Baker | 273/299 X |

FOREIGN PATENT DOCUMENTS

| | | | |
|---|---|---|---|
| 2478479 | 9/1981 | France | 273/283 |
| 636621 | 1/1936 | Germany | 273/283 |

*Primary Examiner*—William E. Stoll

*Attorney, Agent, or Firm*—Donald A. Bergquist

[57] ABSTRACT

A parlor game that, during the play thereof, allows a plurality of players to simulate making purchases and sales transactions involving various tangible properties by dealing with a plurality of fictitious customers with the goal of each player being to maximize his net worth. This game uses parlor game apparatus strips. These parlor game apparatus strips make up a device used as a pathway or trail for playing a parlor game for entertainment, each strip unit being separate from the other, acting together as a playing field having marked spaces constituting a track or pathway of play. Spaces have writing, drawings, pictures, or game options in them.

9 Claims, 22 Drawing Sheets

Strip 1.

Strip 1.

Strip 2.

Strip 3.

Strip 4.

fig. 7

| Sunday | Monday | Tuesday | Wednesday | Thursday | Friday | Saturday |
| --- | --- | --- | --- | --- | --- | --- |
| SELL | TRY SELLING | TRY SELLING | TRY SELLING | TRY SELLING | NO CUSTOMER | TRY SELLING |

Strip 5.

fig. 8

| Sunday | Monday | Tuesday | Wednesday | Thursday | Friday | Saturday |
| --- | --- | --- | --- | --- | --- | --- |
| GO Home | TRY SELLING | TRY SELLING | NO SALES | TRY SELLING | TRY SELLING | TRY SELLING |

Strip 6.

Strip 7.

fig. 10

| Sunday | Monday | Tuesday | Wednesday | Thursday | Friday | Saturday |
|---|---|---|---|---|---|---|
| DAY OFF No Sales! | NO CUSTOMER NO SALES | TRY SELLING | TRY SELLING | TRY SELLING | TRY SELLING | TRY SELLING |

Strip 8.

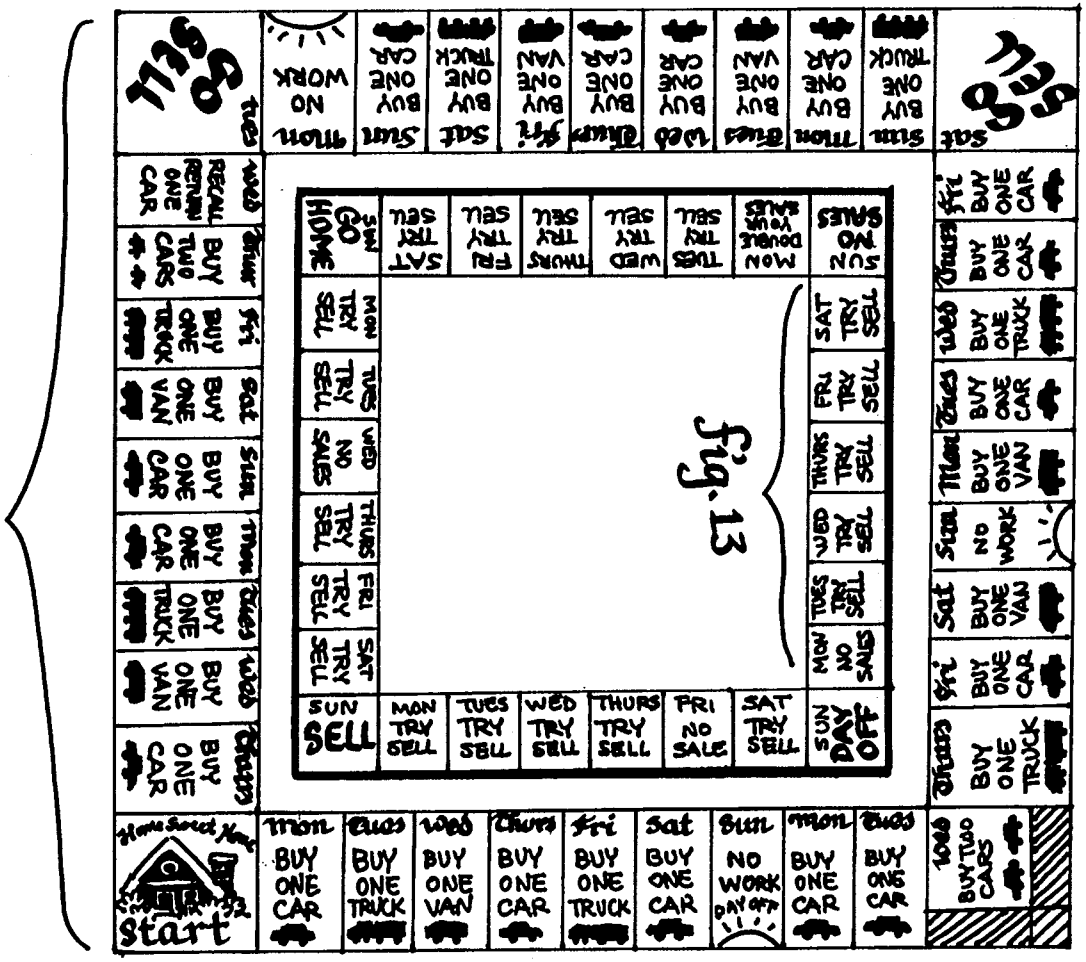
START
BUY ONE CAR
BUY ONE TRUCK
BUY ONE VAN
BUY ONE CAR
NO WORK
BUY ONE CAR
BUY ONE TRUCK
BUY ONE VAN
BUY ONE CAR
BUY TWO CARS
SELL
SUN TRY SELL
MON TRY SELL
TUES TRY SELL
WED NO SALES
THURS TRY SELL
FRI TRY SELL
SAT TRY SELL
SUN GO HOME
MON TRY SELL
TUES TRY SELL
WED NO SALES
THURS TRY SELL
FRI TRY SELL
SAT TRY SELL
SUN DAY OFF
MON NO SALES
TUES TRY SELL
WED TRY SELL
THURS TRY SELL
FRI TRY SELL
SAT TRY SELL
SUN NO SALES
MON DOUBLE YOUR SALES
TUES TRY SELL
WED TRY SELL
THURS TRY SELL
FRI TRY SELL
SAT TRY SELL
SUN NO WORK
MON BUY ONE CAR
TUES BUY ONE CAR
WED BUY ONE CAR
THURS BUY ONE CAR
FRI BUY ONE TRUCK
SAT BUY ONE CAR
SUN NO WORK
MON BUY ONE CAR
TUES BUY ONE TRUCK
WED BUY ONE VAN
THURS BUY ONE CAR
FRI BUY ONE VAN
SAT BUY ONE CAR
SUN BUY ONE TRUCK
MON BUY ONE CAR
TUES BUY ONE VAN
WED BUY ONE CAR
THURS BUY ONE CAR
FRI BUY ONE TRUCK
SAT BUY ONE CAR
SUN BUY ONE VAN
MON BUY ONE CAR
TUES BUY ONE TRUCK
WED BUY ONE VAN
THURS BUY ONE CAR
FRI BUY ONE CAR
SAT BUY ONE CAR
SUN BUY ONE TRUCK
MON BUY ONE CAR
TUES BUY ONE CAR
WED BUY ONE TRUCK
THURS BUY ONE CAR
FRI BUY ONE CAR
SAT BUY ONE CAR
SUN BUY ONE CAR
MON BUY ONE CAR
TUES BUY ONE TRUCK
WED BUY ONE VAN
THURS BUY ONE CAR
FRI BUY TWO CARS
SAT BUY ONE TRUCK
SUN BUY ONE VAN
MON BUY ONE CAR
TUES BUY ONE TRUCK
WED BUY ONE VAN
THURS BUY ONE CAR
FRI BUY ONE CAR
SAT BUY ONE CAR
SUN NO WORK
MON BUY ONE CAR
TUES BUY ONE TRUCK
WED BUY ONE VAN
THURS BUY ONE CAR
FRI BUY ONE CAR
SAT BUY ONE CAR
SUN BUY ONE TRUCK
MON BUY ONE CAR
TUES GO SELL
WED RECALL RETURN ONE CAR
THURS BUY TWO CARS
FRI BUY ONE TRUCK
SAT BUY ONE VAN
SUN BUY ONE CAR
MON BUY ONE CAR
TUES BUY ONE TRUCK
WED BUY ONE VAN
THURS BUY ONE CAR
FRI BUY ONE CAR
SAT BUY ONE CAR fig. 19
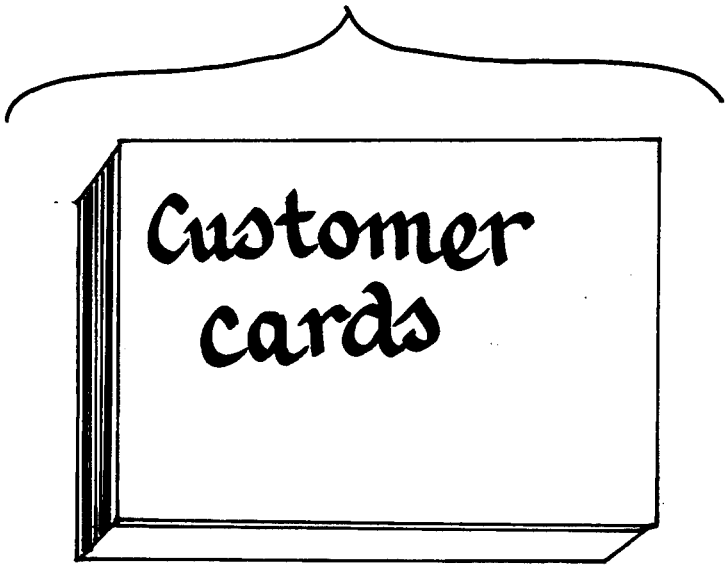
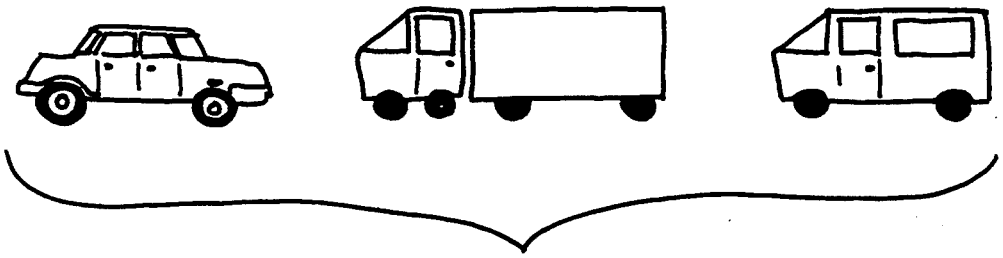
fig. 20

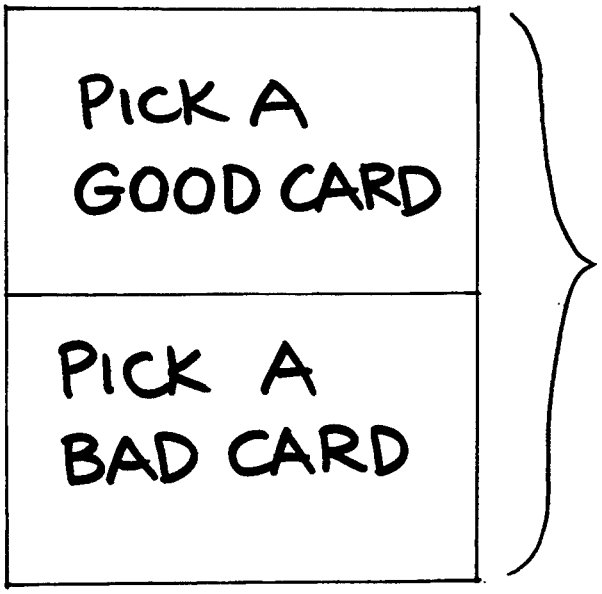
fig. 25
fig. 26
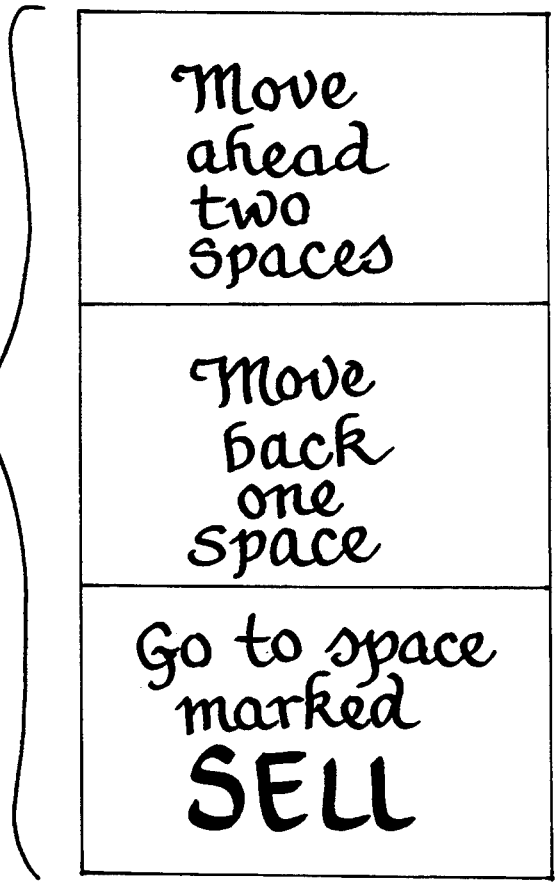

PARLOR GAME APPARATUS STRIPS

BACKGROUND OF THE INVENTION

Games, and particularly board games, having cards with questions to answer, thereby to determine a person's progress toward the goal of the game are well known.

It is the purpose of the present invention, however, to provide a novel and unique game that is played on the parlor game apparatus strips to simulate buying and selling to fictitious customers.

SUMMARY OF THE INVENTION

The object of the present invention is to provide a new and unique parlor game, simulating buying and then simulating selling to fictitious customers, using the parlor game apparatus strips as a pathway of play having marked spaces.

In the preferred embodiment of the invention:

A. Parlor game apparatus strips are placed to form the playing field made up of a larger, or outer pathway and a smaller, or inner pathway.

B. Players take turns throwing dice and going around the outer pathway following instructions on the spaces on which they land. The larger pathway of the preferred embodiment is designed for the players to simulate buying cars, trucks, and mini-vans. Some marked spaces allow players the option of moving to the smaller board game apparatus strips pathway. Some marked spaces allow players to make purchases of representations of cars, trucks, or other type vehicles.

C. Simulating buying and selling as accomplished through the use of play money.

D. The smaller strips pathway of the preferred embodiment is designed for the players to simulate selling the representations of vehicles by moving to and landing on certain spaces with instructions on them.

E. A plurality of cards is provided with the game, these cards being unique in that they represent different fictitious customers. Some fictitious customers are capable of buying, some perhaps not.

F. Should a player land on a space marked to sell, and he has in his inventory at least one vehicle, that player draws one of the fictitious customer cards. If the fictitious customer thus selected wants to buy a truck, for example, the player must have a truck in his inventory for the sale to be made. Should the player not have a truck, the sale is lost.

G. In the preferred embodiment, the object is to simulate buying and selling as many vehicles as possible to accumulate play money. The winner is the player having the most play money at the conclusion of play.

H. One of the entertaining aspects of the invention is the simulated buying and selling; in a specific example of the parlor game apparatus strips, the spaces being marked days of the week, simulating work days on a job; some days are better than others.

BRIEF DESCRIPTION OF THE DRAWINGS

These and other objects and advantages of the invention will become apparent upon reading the following detailed description and upon referring to the drawings in which:

FIG. 7 illustrates a game strip #5 of the type shown in FIG. 2 and bearing indicia relating to the preferred embodiment of the invention.

FIG. 8 illustrates a game strip #6 of the type shown in FIG. 2 and bearing indicia relating to the preferred embodiment of the invention.

FIG. 10 illustrates a game strip #8 of the type shown in FIG. 2 and bearing indicia relating to the preferred embodiment of the invention.

FIG. 12 illustrates a playing field portion in the form of a circuit and includes playing spaces for purchasing only.

FIG. 13 illustrates a playing field portion in the form of a circuit and includes playing spaces for selling only.

FIG. 19 illustrates a stack of fictitious customer cards as they would appear face-down during the playing of the game of this invention.

FIG. 20 illustrates three representations of vehicles that are examples of the tangible property bought and sold in the preferred mode of this invention.

FIG. 25 illustrates typical instruction-bearing indicia that may appear on a game strip.

FIG. 26 illustrates additional instruction-bearing indicia that may appear on a game strip.

DETAILED DESCRIPTION OF THE INVENTION

Figure 1:
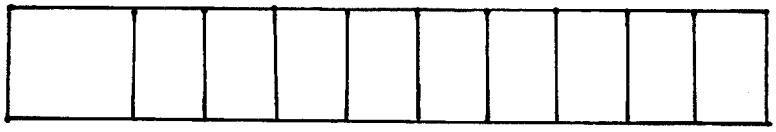
FIG. 1 illustrates a blank game strip of a type used in this invention.

FIG. 1 shows a view of an example of one unit making up a parlor game apparatus strip; in this example, it is marked with ten spaces.

Figure 2:
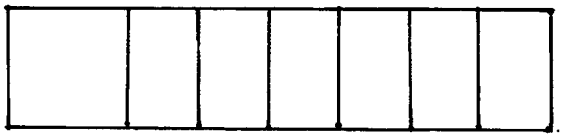
FIG. 2 illustrates a smaller blank game strip of a type used in this invention.

FIG. 2 shows a view of an example of a smaller parlor game apparatus strip; this unit being marked with seven spaces.

Figure 3:
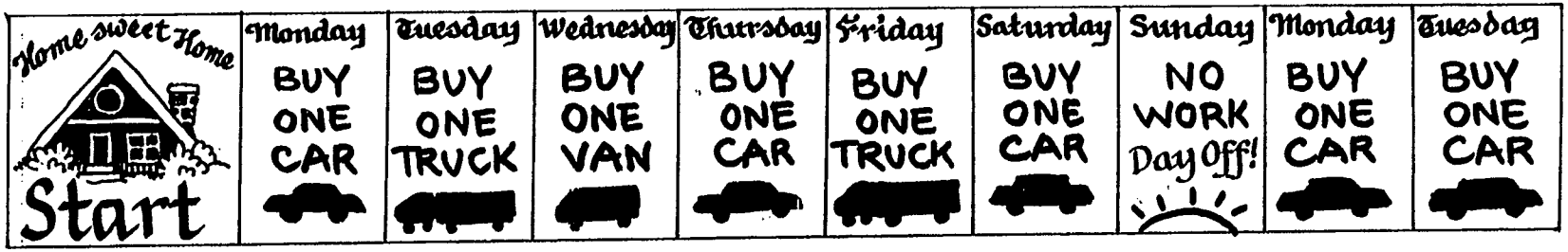
FIG. 3 illustrates a game strip #1 of the type shown in FIG. 1 and bearing indicia relating to the preferred embodiment of the invention.

FIG. 3 shows an example pertaining to the preferred embodiment of the invention being marked with ten spaces and contains writing. The first space having "HOME SWEET HOME" marked on it and also having a drawing of a house on the space. The second space having the words, "MONDAY" and "BUY ONE CAR" on it The third space having the words, "TUESDAY" and "BUY ONE TRUCK" on it. The fourth space having the words, "WEDNESDAY" and "BUY ONE VAN" on it. The fifth space having the words, "THURSDAY" and "BUY ONE CAR" on it. The sixth space having the words, "FRIDAY" and "BUY ONE TRUCK" on it. The seventh space having the words, "SATURDAY" and "BUY ONE CAR" on it. The eighth space having the words, "SUNDAY" and "NO WORK, DAY OFF" marked on it The ninth space having the words, "MONDAY" and "BUY ONE CAR" on it. The tenth space having the words, "TUESDAY" and "BUY ONE CAR" in it. Should a player land or move to one of these marked "BUY" and he does have the appropriate amount of play money, he can purchase one of the representations of vehicles and hold it in inventory to later be sold to a fictitious customer. We will refer to this strip example as strip #1.

Figure 4:
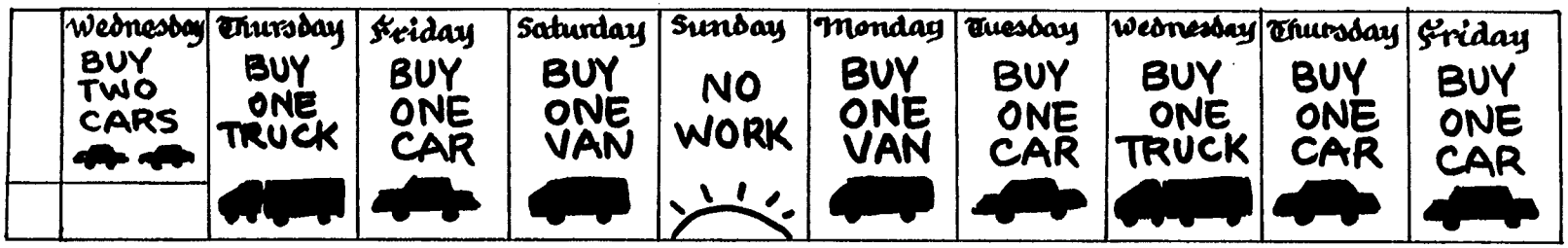
FIG. 4 illustrates a game strip #2 of the type shown in FIG. 1 and bearing indicia relating to the preferred embodiment of the invention.

FIG. 4 shows an example of the board game apparatus strip being ten spaces; it contains writing pertaining to the preferred embodiment of the invention. We will refer to this strip example as strip #2.

Figure 5:
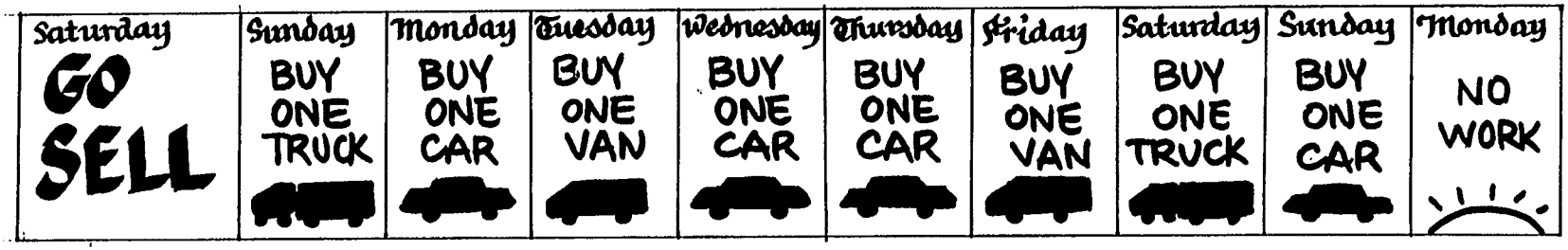
FIG. 5 illustrates a game strip #3 of the type shown in FIG. 1 and bearing indicia relating to the preferred embodiment of the invention.

FIG. 5 shows an example of the invention (board game apparatus strips) being ten spaces. We will refer to this strip example as strip #3.

Figure 6:
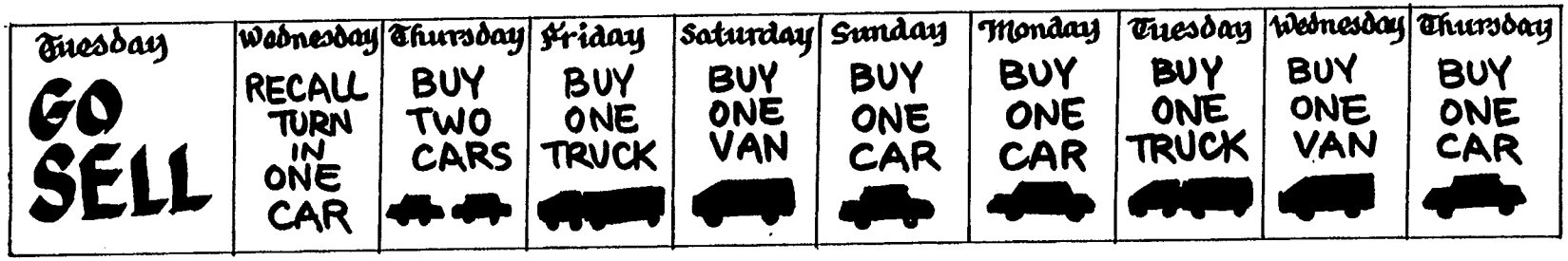
FIG. 6 illustrates a game strip #4 of the type shown in FIG. 1 and bearing indicia relating to the preferred embodiment of the invention.

FIG. 6 shows an example of the board game apparatus strip being ten spaces. We will refer to this strip example as strip #4.

FIG. 7 shows an example pertaining to the preferred embodiment of the invention and being marked with seven spaces and containing writing. The first space having "SUNDAY" and "DAY OFF" marked on it.

The player landing in this space or the sixth space that has "FRIDAY" and "NO CUSTOMERS" marked on it cannot sell to one of the fictitious customers. The second, third, fourth, fifth, and seventh marked spaces having the words marked "TRY SELLING" pertain to the following rule: Should a player land or move to one of these spaces, he can draw one of the fictitious customer cards. If he has the correct vehicle in stock, he may elect to sell it and collect the appropriate amount of play money. We will refer to this strip example as strip #5.

FIG. 8 shows an example pertaining to the board game apparatus strip being marked with seven spaces. We will refer to this strip example as strip #6.

Figure 9:
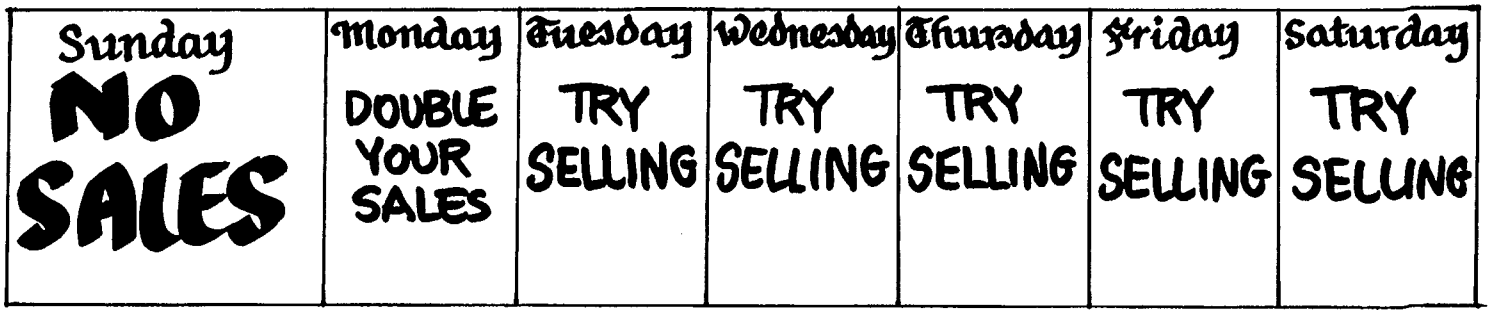
FIG. 9 illustrates a game strip #7 of the type shown in FIG. 2 and bearing indicia relating to the preferred embodiment of the invention.

FIG. 9 shows an example pertaining to the board game apparatus strip being marked with seven spaces. We will refer to this strip example as strip #7.

FIG. 10 shows an example pertaining to the board game apparatus strip being marked with seven spaces. We will refer to this strip example as strip #8.

Figure 11:
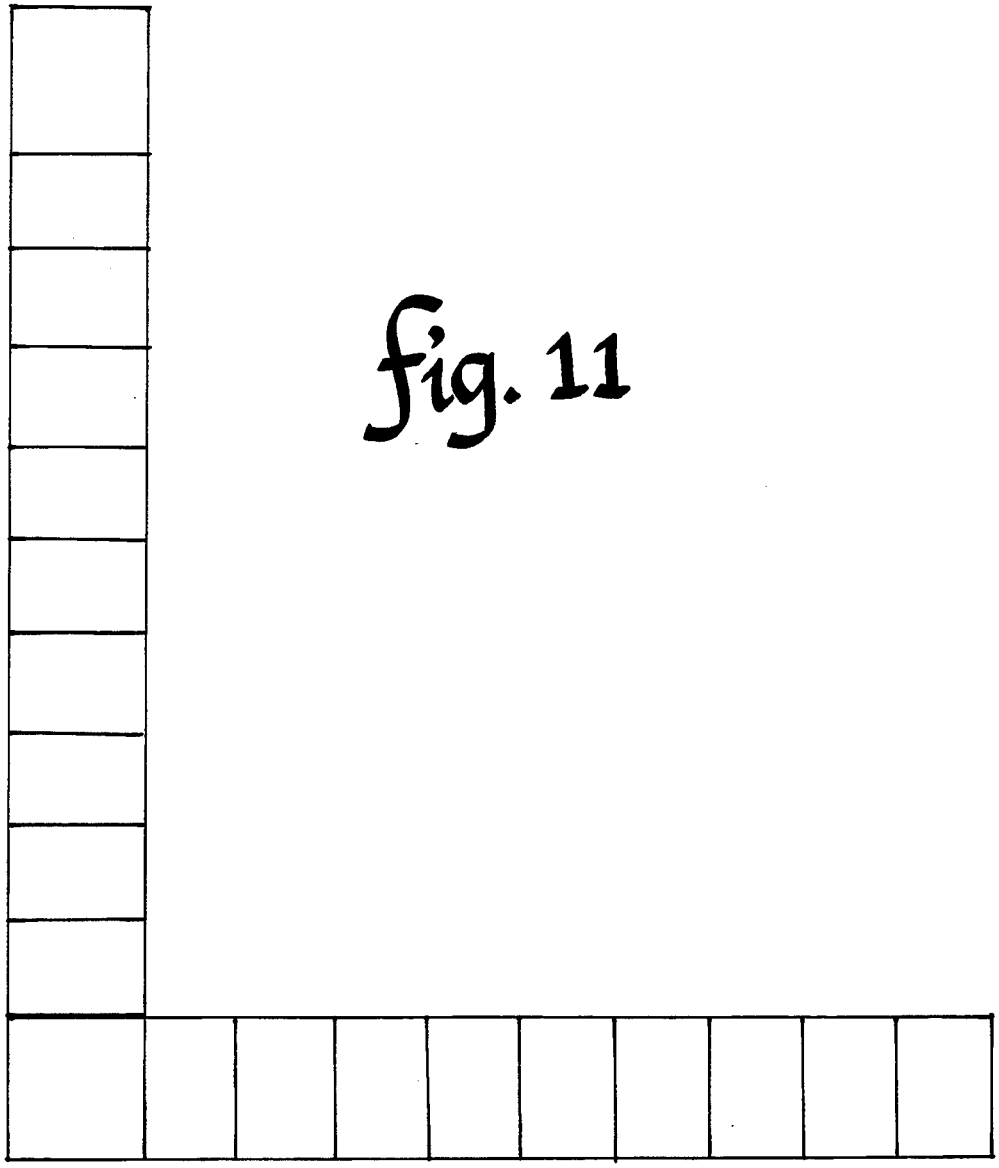
FIG. 11 illustrates two game strips of the type shown in FIG. 1 joined to form an angled portion of a playing field.

FIG. 11 shows an example of two parlor game apparatus strips being laid down to start an example of a game pathway. Each strip is marked with ten spaces. They are laid down end to end.

FIG. 12 shows strips #1, #2, #3, and #4 laid out for the example of play described herein for the simulated purchase of vehicles. They are the same strips as shows in FIG. 3, FIG. 4, FIG. 5, and FIG. 6.

FIG. 13 shows strips #5, #6, #7, and #8 laid out for the example of play described herein for the simulated selling to fictitious customers. They are the same strips as shown in FIG. 7, FIG. 8, FIG. 9, and FIG. 10.

Figure 14:
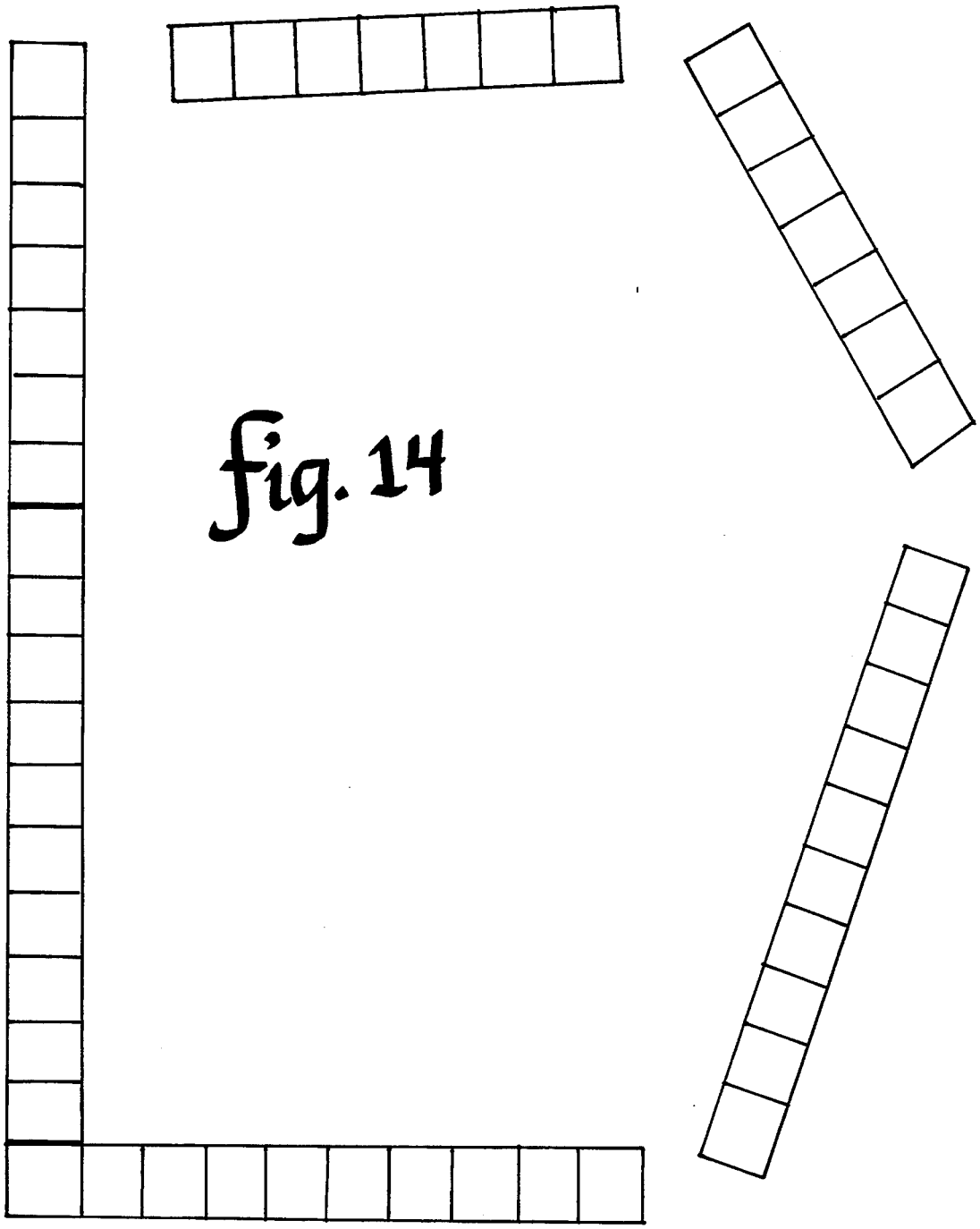
FIG. 14 illustrates a plurality of game strips arranged to form a random-shaped playing field.

FIG. 14 shows a view of a plurality of parlor game apparatus strips of different sizes, shapes, and a different number of marked spaces acting as a field of play constituting a path or course of play.

Figure 15:
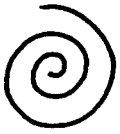
FIG. 15 illustrates an end view of a flexible playing strip rolled in a coil for storage.

FIG. 15 shows a side view of an example of a rolled-up flexible parlor game apparatus strip.

Figure 16:
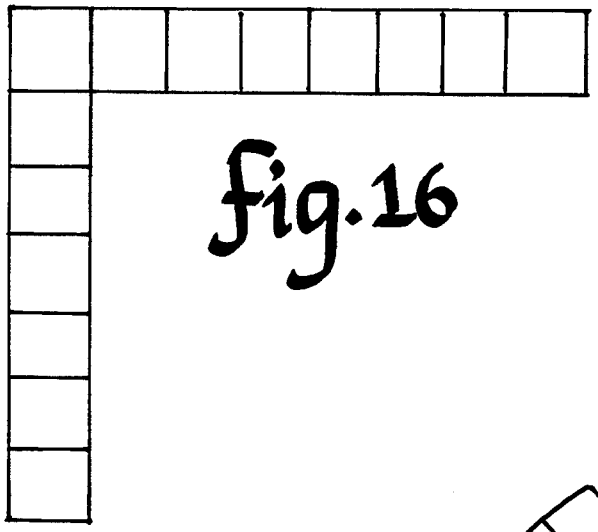
FIG. 16 illustrates an angularly shaped game strip.

FIG. 16 shows an example of a non-straight parlor game apparatus strip.

Figure 17:
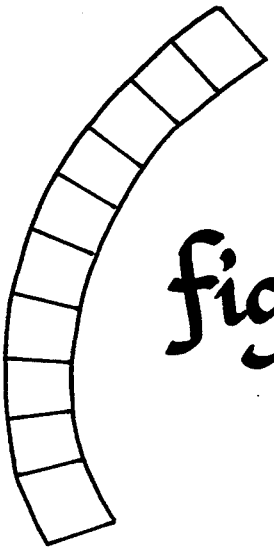
FIG. 17 illustrates a curved game strip.

FIG. 17 shows an example of a curved parlor game apparatus strip. FIG. 1, FIG. 14, FIG. 16, and FIG. 17 all show the diversified use of a mix and match type use of the different shape parlor game apparatus strips.

FIG. 20 shows a drawing of an example of a plurality of representations of vehicles used for players to simulate buying in the preferred embodiment of the invention, specifically representations of cars, trucks, and mini-vans.

FIG. 25 shows an example of one or more spaces having indicia indicative of penalties or benefits to the players; these would be spaces marked on the parlor game apparatus strips.

FIG. 26 shows an example of spaces on the parlor game apparatus strips, marked spaces indicating movement to other spaces or going backward or forward a specified number of spaces.

Figure 27:
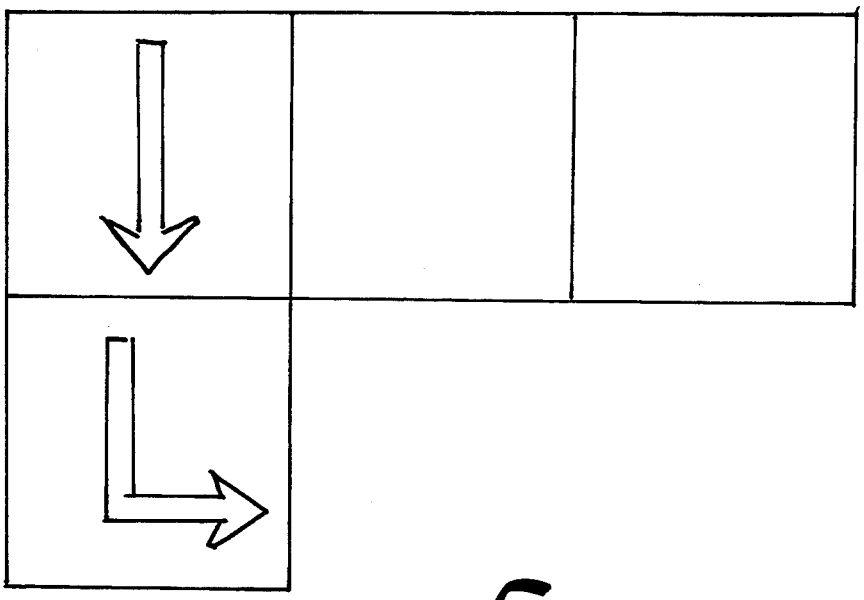
FIG. 27 illustrates indicia that may appear on a game strip to show direction of movement along the strip.

FIG. 27 shows an example of marked spaces with or without directional indicators on them to show players the direction of movement on the parlor game apparatus strips.

Figure 28:
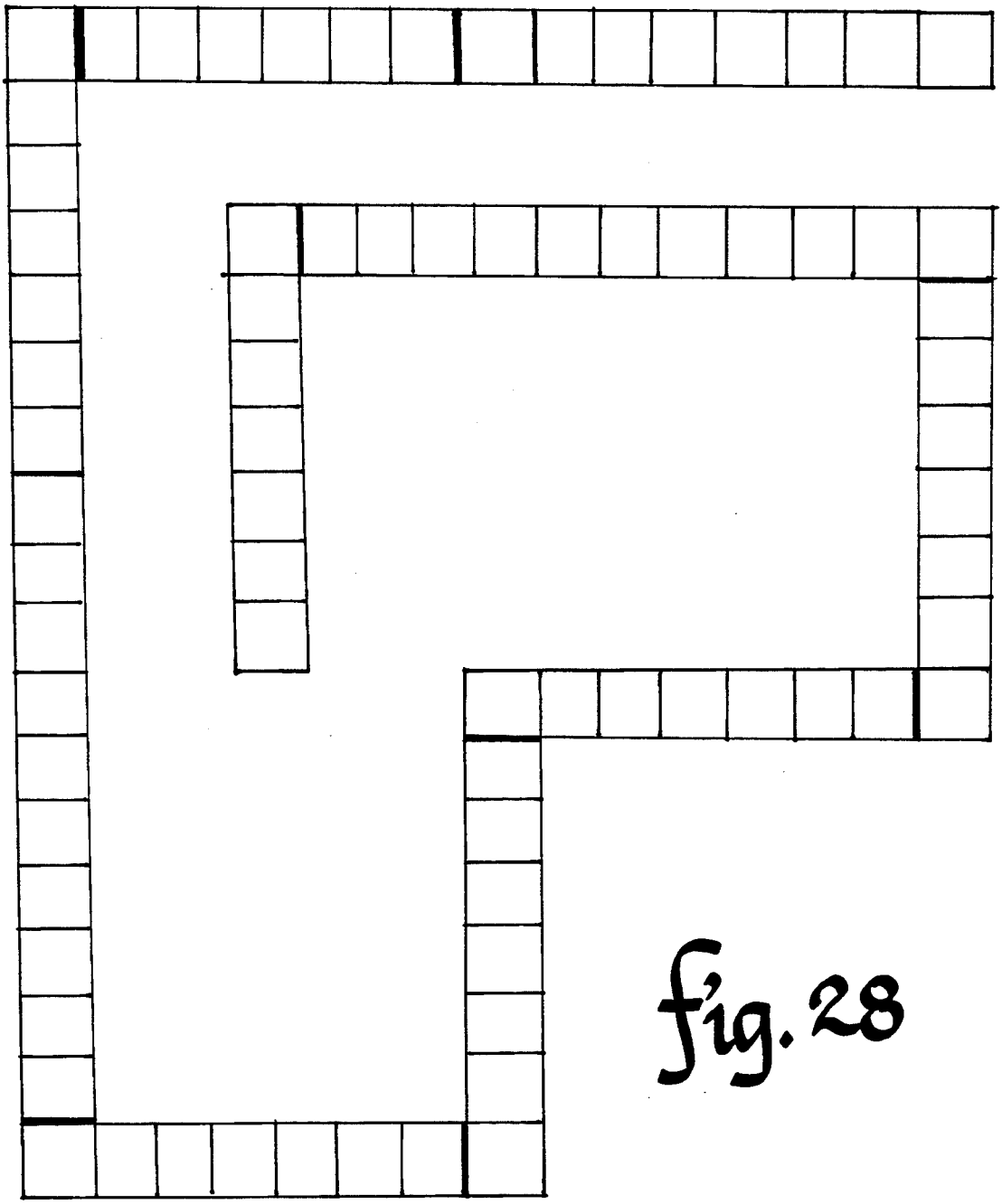
FIG. 28 illustrates game strips arranged to form a maze-like playing field.

FIG. 28 shows a drawing of an example of a maze type arrangement of the parlor game apparatus strips to form a maze-like pathway of play. A plurality of pathways can be mapped out.

Figure 29:
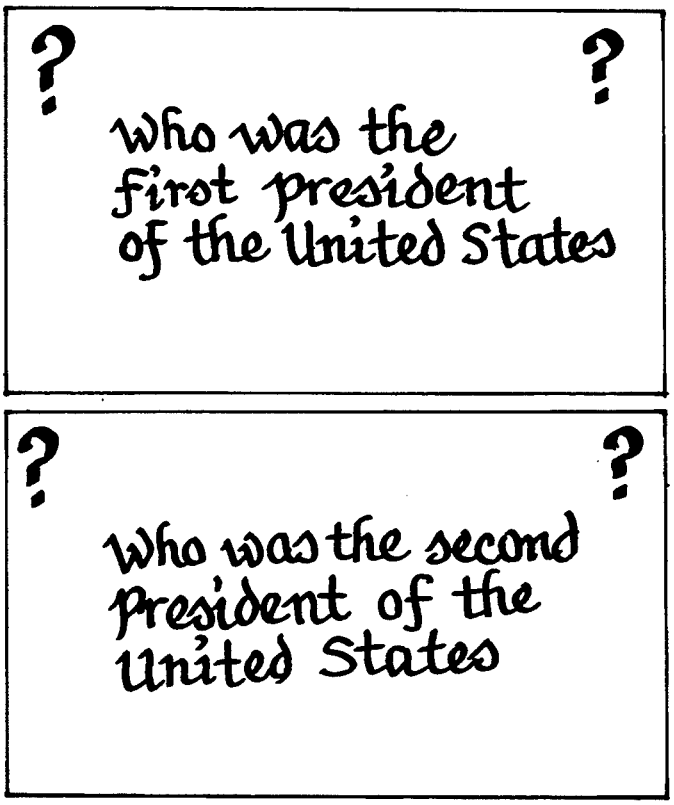
FIG. 29 illustrates indicia that may appear on a game strip to ask questions that must be correctly answered by a player.

FIG. 29 shows a drawing of an example with marked spaces on the parlor game apparatus strips and within marked spaces a plurality of categories asking different questions of players landing on those spaces.

Figure 30:
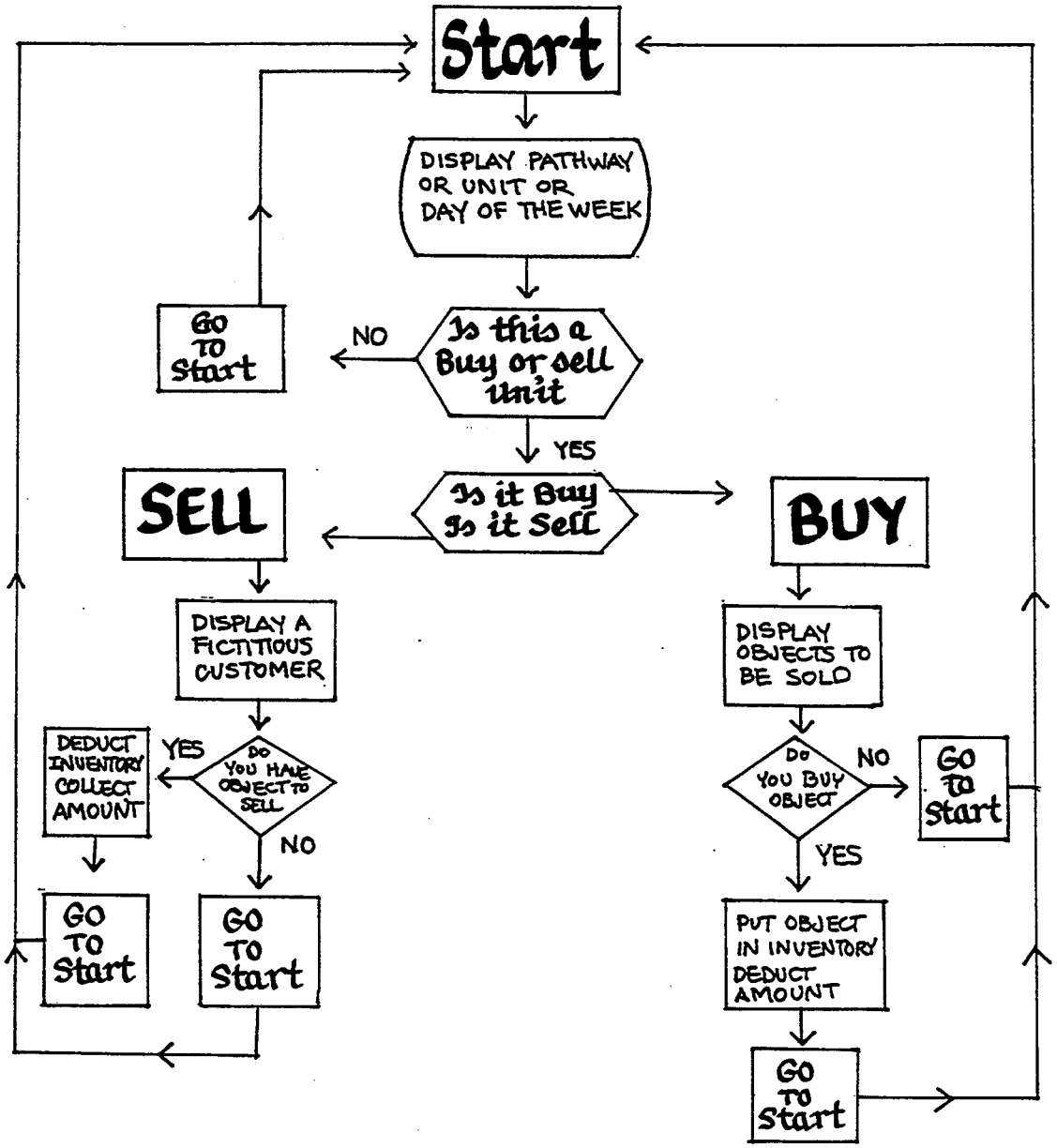
FIG. 30 illustrates a logic diagram for a computer-based version of the game of this invention.

FIG. 30 shows an example of a flow chart of the commands when the game of the present invention is played on a programmed video game cartridge or programmed on a computer system. The video game cartridge or computer system is programmed to simulate the present invention.

Figure 31:
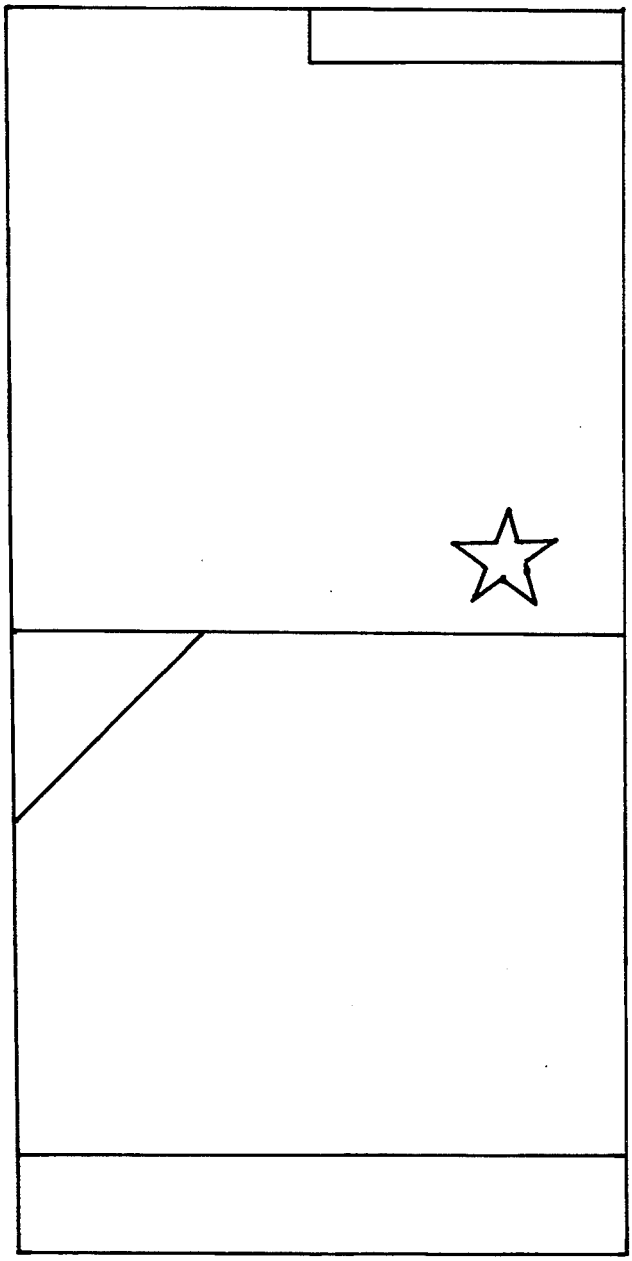
FIG. 31 illustrates typical spaces on a game strip to show that sub-spaces or symbols may be included in any single space.

FIG. 31 shows an example of spaces marked, and within these spaces, are sub-spaces or symbols.

Figure 18:
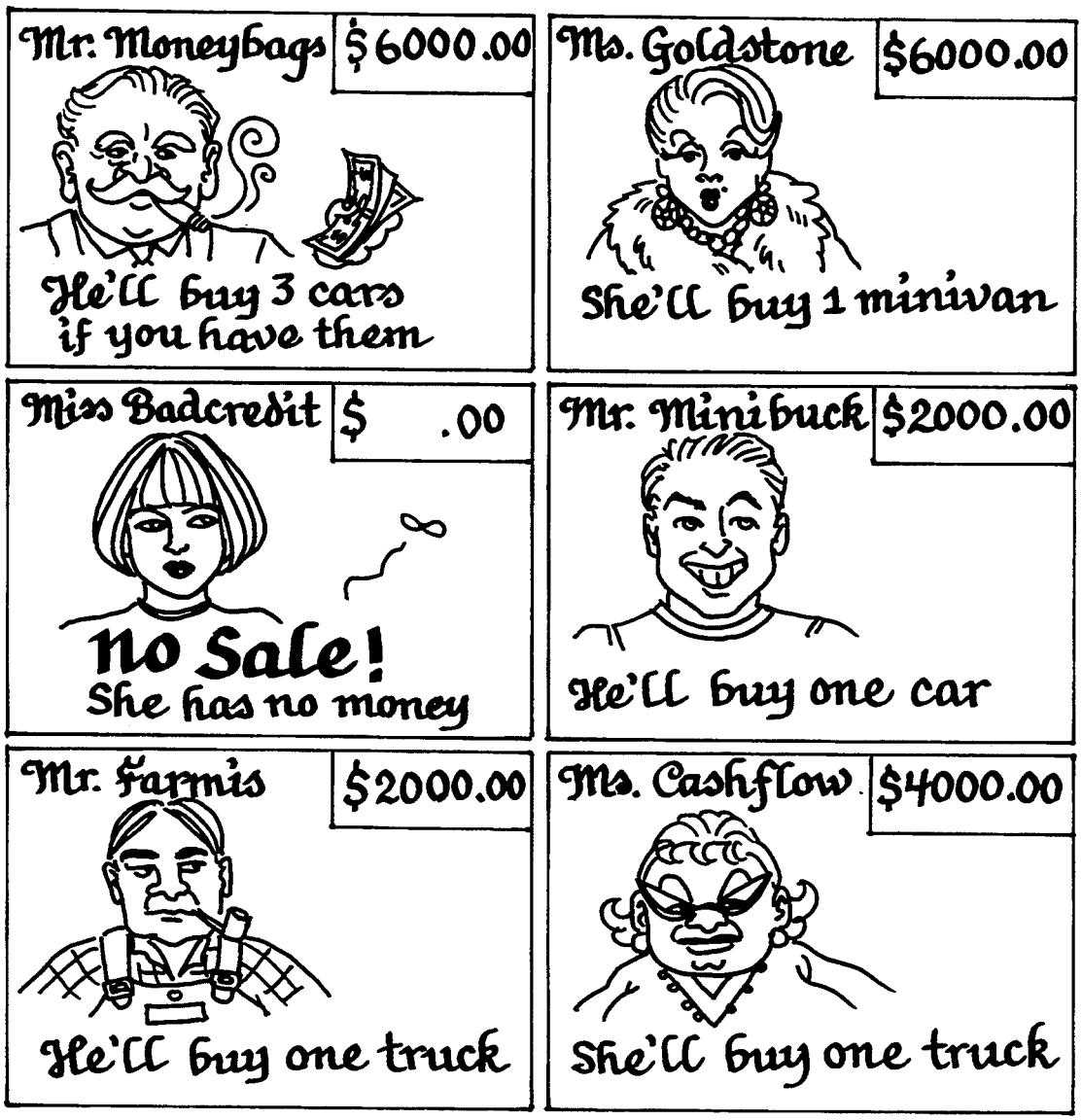
FIG. 18 illustrates six examples of fictitious customer cards featured in this invention.

FIG. 18 shows six examples of the unique fictitious customer cards; each of these cards can bear a drawing, or a picture or a facsimile of a fictitious customer used in the invention of the game. Each customer card indicates a fictitious customer's willingness and ability to make a purchase.

FIG. 19 shows a plurality of fictitious customer cards used for players to simulate selling to these fictitious customers in the preferred embodiment of the invention.

Figure 23:
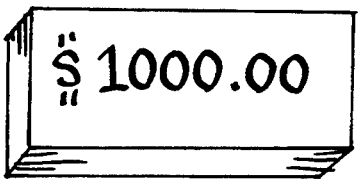
FIG. 23 illustrates a stack of play money as used in the play of the game of this invention.

FIG. 23 shows a plurality of play money used by players simulating buying and selling.

Figure 21:
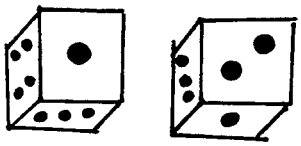
FIG. 21 illustrates dice that may be used to generate random numbers for the play of the game of this invention.

FIG. 21 shows a pair of dice used by players to determine the extent of a player's movement along the path or course using the parlor game apparatus strips.

Figure 24:
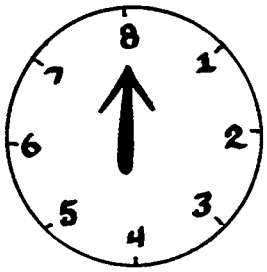
FIG. 24 illustrates a spinner that may be used to generate random numbers for the play of the game of this invention.

FIG. 24 shows an example of a spinner that can as well be used by players to determine the extent of a player's movement along the path or course using the parlor game apparatus strips.

Figure 22:
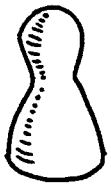
FIG. 22 illustrates a player's game piece as used in the play of the game of this invention.

FIG. 22 shows an example of objects or tokens used to identify each player as they move along the path or spaces on the parlor game apparatus strips. DESCRIPTION OF THE PREFERRED EMBODIMENT With reference now to the drawings:

FIG. 1 and FIG. 2 show the parlor game apparatus strips acting as a playing field having marked spaces constituting a path or course of play, each space marked may or may not have writing, drawings, pictures or game options within them. In these examples, the marked spaces are printed with words pertaining to buying as in FIG. 3 and selling as in FIG. 7.

With reference now to the drawings, and particularly to FIG. 1, the new and unique parlor game strips acting as a playing field having marked spaces constituting a track or pathway of play. Being on different pathways makes the game different from other great games sold under the trademarks of Life, Clue, Monopoly, and Careers. As in most board games, players roll dice for movement on the playing field. At the start of the game each player receives an amount of play money, $20,000, for example. As players move, starting on the larger parlor game strips pathway where purchases may be made, should they land on certain marked spaces marked "BUY ONE TRUCK," or "BUY ONE CAR," or "BUY ONE MINI-VAN," then the player has the option to make the purchase or not. The theme of the outer pathway, the "purchasing" pathway, is to purchase as many vehicles as possible.

The vehicles being purchased are tokens in the form of cars, trucks or mini-vans. Cars are purchased for example for $1,000, and sell for $2,000. Trucks are purchased for example at $2,000 and sell for $4,000. Mini vans are purchased for example at $3,000 and sell for $6,000. Some player may be on the smaller parlor game strips pathways, while others may be on the larger parlor game strips.

As play progresses, the player may move onto a space that says, "GO SELL." If the player feels he has a good inventory of vehicles and wants to try to sell them, then he can move into the smaller pathway, the "selling" pathway. He may opt to stay on the purchasing pathway. The smaller pathway is designed in this example for the player to try to sell. Featured in this unique game are the fictitious customer cards.

Should a player land on an inner space marked "SELL," the player takes a randomly-selected fictitious customer card. In this example these cards are marked with the type of vehicle the customer wants to buy. Also marked is the price the customer is willing to pay for such a vehicle and, preferably, a cartoon-type humorous drawing of the customer. If the player has the vehicle in his stock, he can sell it to the customer. If he does not have the vehicle in stock, the sale is lost.

If the player needs more inventory, he may return to the "purchasing" pathway, where he is allowed to make purchases, only if he manages to land on a space marked, "YOU CAN GO HOME." This moves him back to the "HOME" space on the parlor game "purchasing" pathway.

The customer cards are a unique deck of cards. For example, 50 cards are used in play at the start of the game and are shuffled and placed face down. The game is based on a real-life situation-that of working on a car lot. Similar to the situations faced by a real car salesperson, each player tries to have on his lot the vehicle the customer wants to buy. To sell, the player must have a customer. As we all know, customers all are different.

Some sales are made; others are not. The diversified use of the parlor game apparatus strips makes this game path maker unique; a plurality of paths can be achieved. The path used need not be a closed circuit as illustrated in FIG. 12.

Another feature of the parlor game apparatus strips is that one can lay out the strips and start play in one room of one's home and end in another. Or, one may run the strips outside and play down one's driveway. Thus, the invention of the game is versatile and original.

Having thus described one illustrative embodiment of the invention, it is to be understood that although specific terms are employed, those terms are used in a generic and descriptive sense and not for purposes of limitations to the scope of the invention being set forth in the following claims.

What is claimed is:

1. A parlor game that, during the play thereof, allows a plurality of players to simulate making purchases and sales transactions involving various tangible properties by dealing with a plurality of fictitious customers with the goal of each player to maximize his net worth, said game comprising:

a) a playing field comprising a plurality of playing strips arranged at the discretion of said players to form at least one pathway upon which a game piece for each player is to be moved, said playing strips each bearing a plurality of marked-off spaces, each space bearing indicia, said indicia including indicia that suggest an action to be taken when a game piece is moved to that space as a result of being moved a randomly-selected number of spaces from a prior location on said playing field;

b) an apparatus for randomly selecting one number from a limited set of numbers, said one number indicating said randomly-selected number of spaces for said game piece to be moved;

c) a plurality of tokens representing said various tangible properties that change hands in exchange for other assets including play money in effecting said transactions;

d) a plurality of cards having an obverse and a reverse face, each card bearing, on one face thereof, indicia in the form of a representation of one customer of said plurality of fictitious customers and also bearing on said one face information regarding the ability and desire of said one customer to enter into a transaction, each card thereby presenting one of several possible opportunities relating to an attempted transaction; whereby, each player in rotation is given randomly-determined opportunities upon moving his game piece by randomly-selected moves around said playing field, following directions thereon, to attempt purchases and sales transactions with said fictitious customers, the selection of each customer and the possible outcome of each said transaction attempt being indicated by randomly-selected cards, and the outcome of the transaction attempt sometimes being determined by said cards and sometimes being determined by a player's decision as to the consummation of the transaction attempt, thereby to affect his net worth.

2. The parlor game of claim 1 wherein said tangible properties are simulated motor vehicles represented by miniatures.

3. The parlor game of claim 2 wherein said motor vehicles comprise vehicles of the types cars, trucks, and minivans, and wherein each type of vehicle bears a different purchase price from other types of vehicle and a different selling price from other types of vehicle.

4. The parlor game of claim 1 wherein said apparatus for randomly selecting one number from a limited set of numbers comprises a spinner.

5. The parlor game of claim 1 wherein said apparatus for randomly selecting one number from a limited set of numbers comprises a die.

6. The parlor game of claim 1 wherein said playing field comprises a plurality of playing strips arranged in a closed arrangement to form a circuit, thereby to allow continuous repetitive movement of playing pieces around said circuit.

7. The parlor game of claim 6 wherein said playing field comprises a plurality of playing strips of two types arranged in nested closed arrangments to form two nested circuits to allow continuous repetitive movement of playing pieces around each of said two nested circuits.

8. The parlor game of claim 1 wherein said playing field comprises a plurality of playing strips arranged in a random pattern to form an elongated playing field.

9. The parlor game of claim 1 wherein said playing field comprises a plurality of playing strips of two types arranged in a random pattern to form an elongated playing field featuring two tracks.

* * * * *